US005966974A

United States Patent [19]

Song

[11] Patent Number: 5,966,974

[45] Date of Patent: Oct. 19, 1999

[54] AUTOMATIC LEARNING APPARATUS FOR FOLDING MACHINE

[75] Inventor: Byung-Jun Song, Kwangmyung, Rep. of Korea

[73] Assignee: SDS USA, Inc., Northvale, N.J.

[21] Appl. No.: 09/081,740

[22] Filed: May 19, 1998

[51] Int. Cl.[6] ..... B21D 5/04

[52] U.S. Cl. ..... 72/18.2; 72/17.3; 72/307; 72/319

[58] Field of Search ..... 72/17.3, 18.2, 72/15.3, 16.2, 31.1, 319, 307

[56] References Cited

U.S. PATENT DOCUMENTS

| | | | |
|---|---|---|---|
| 4,131,003 | 12/1978 | Foster | 72/31.1 |
| 4,640,113 | 2/1987 | Dieperink | 72/16.2 |
| 4,732,025 | 3/1988 | Marlinga | 72/31.1 |
| 5,005,394 | 4/1991 | Sartorio | 72/31.1 |
| 5,285,668 | 2/1994 | Tokai | 72/17.3 |

FOREIGN PATENT DOCUMENTS

| | | | |
|---|---|---|---|
| 1076608 | 3/1960 | Germany | 72/319 |
| 168725 | 10/1982 | Japan | 72/16.2 |

*Primary Examiner*—Daniel C. Crane
*Attorney, Agent, or Firm*—F. Chau & Associates, LLP

[57] ABSTRACT

An automatic learning apparatus for a folding machine which automatically measures a folding angle of a member to be folded in advance and stores driving data for the folding machine with respect to a desired folding angle. Thus, the same member to be folded is folded using the previously obtained driving data. Accordingly, the automatic learning apparatus can obtain such driving data with respect to the desired folding angle swiftly and accurately.

8 Claims, 6 Drawing Sheets

AUTOMATIC LEARNING APPARATUS FOR FOLDING MACHINE

BACKGROUND OF THE INVENTION

1. Field of the Invention

The present invention relates to an automatic learning apparatus for a folding machine, and more particularly, to an automatic learning apparatus for a folding machine in which a folding angle of a workpiece to be folded is automatically measured in advance, and the workpiece is accurately folded using the measured data.

2. Description of the Related Art

Various folding machines have been known for automatically folding a workpiece at a predetermined angle to conform to a particular use. The automatic folding machine includes a folding member for folding the workpiece by gripping the workpiece at a predetermined position and rotating the folding member to fold the workpiece, and a driving unit for causing the folding member to rotate. A folding angle of the workpiece is determined according to driving data applied to the driving unit. The driving data varies according to a shape or a material of a workpiece even when an identical folding angle is obtained. Thus, specific driving data which is applied to the driving unit is required in order to fold a particular workpiece at a predetermined angle.

In prior art folding machines, a folding angle of the workpiece is manually measured by manually applying target driving data to the driving unit, and altering the driving data if the measured angle turns out not to be at a predetermined angle. This procedure is repeated until the workpiece achieves the predetermined angle. Thus, the driving data present when the workpiece equals the predetermined angle is used as the driving data for folding.

The above conventional art has, however, a cumbersome problem in that folding angles are manually measured one by one in order to obtain optimal driving data. Also, since an angle is measured manually, the accuracy of the folding angle is lowered. Further, since the driving data is obtained manually or by trial and error, much time is needed to obtain the correct driving data before the workpiece can be folded.

SUMMARY OF THE INVENTION

To solve these and other problems, it is an object of the present invention to provide an automatic learning apparatus for a folding machine capable of obtaining driving data automatically.

According to one aspect to accomplish an object of the present invention, there is provided an automatic learning apparatus for a folding machine, comprising:

a folder including a folding member for folding a transferred member to be folded and a driving unit for rotating the folding member; a rotation amount transferring member whose one end grips the end of the member to be folded and other end is coupled to a shaft of an encoder, for transferring the folding rotation amount of the member to be folded to the shaft of the encoder; and an encoder coupled to the folder, for measuring a folding angle of the member to be folded by outputting the rotation amount transferred from the rotation amount transferring member in a pulse form.

According to another aspect of the present invention, there is also provided an automatic learning apparatus for a folding machine, comprising:

a folder including a folding member for folding a transferred member to be folded and a driving unit for rotating the folding member; a position detector attached to a rotary body of the folding member, including a plurality of position detection sensors each applying a detection signal with respect to a folding position of the member to be folded to a controller; and the controller having means for measuring a folding angle of the member to be folded using the detection signal applied from the position detector.

BRIEF DESCRIPTION OF THE DRAWINGS

The preferred embodiments are described with reference to the drawings wherein.

DETAILED DESCRIPTION OF PREFERRED EMBODIMENTS

Preferred embodiments of the present invention will be described in detail with reference to the accompanying drawings.

Prior to describing the present invention, a prior art folding machine involving the present invention will be described below.

Figure 1:
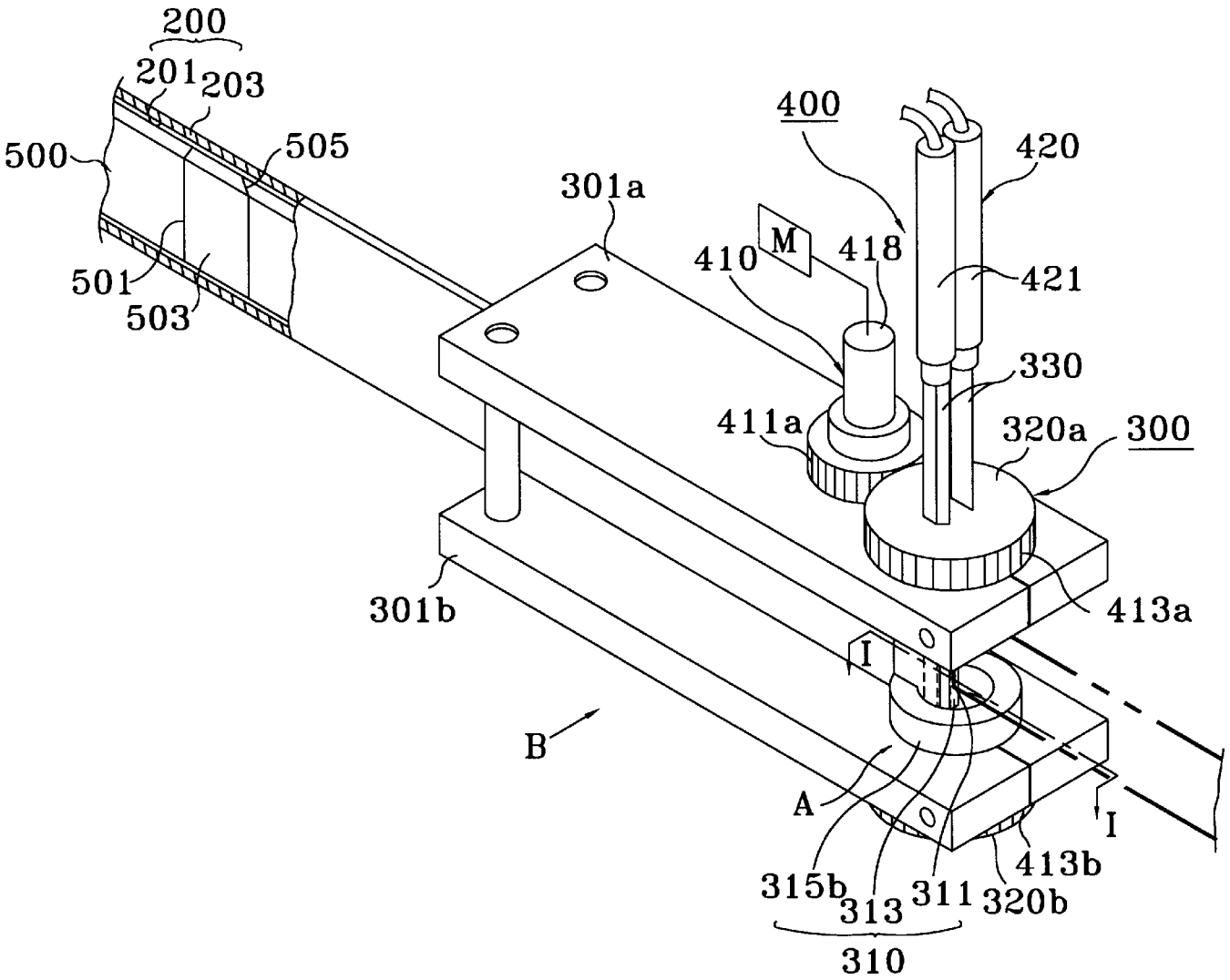
FIG. 1 (PRIOR ART)
FIG. 1 is a perspective view showing a conventional folding machine.
Figure 2:
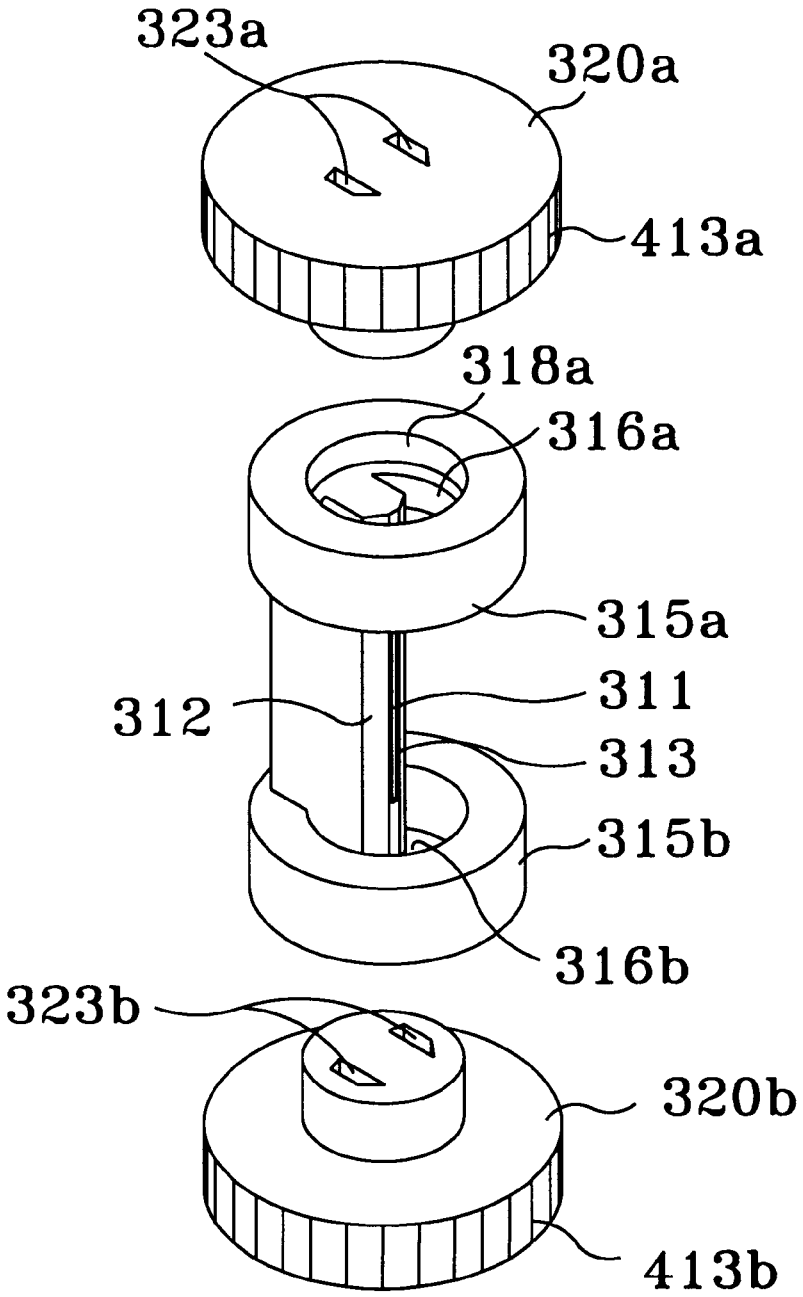
FIG. 2(PRIOR ART)
FIG. 2 is an exploded perspective view showing essential elements of a conventional folding member.
Figure 3:
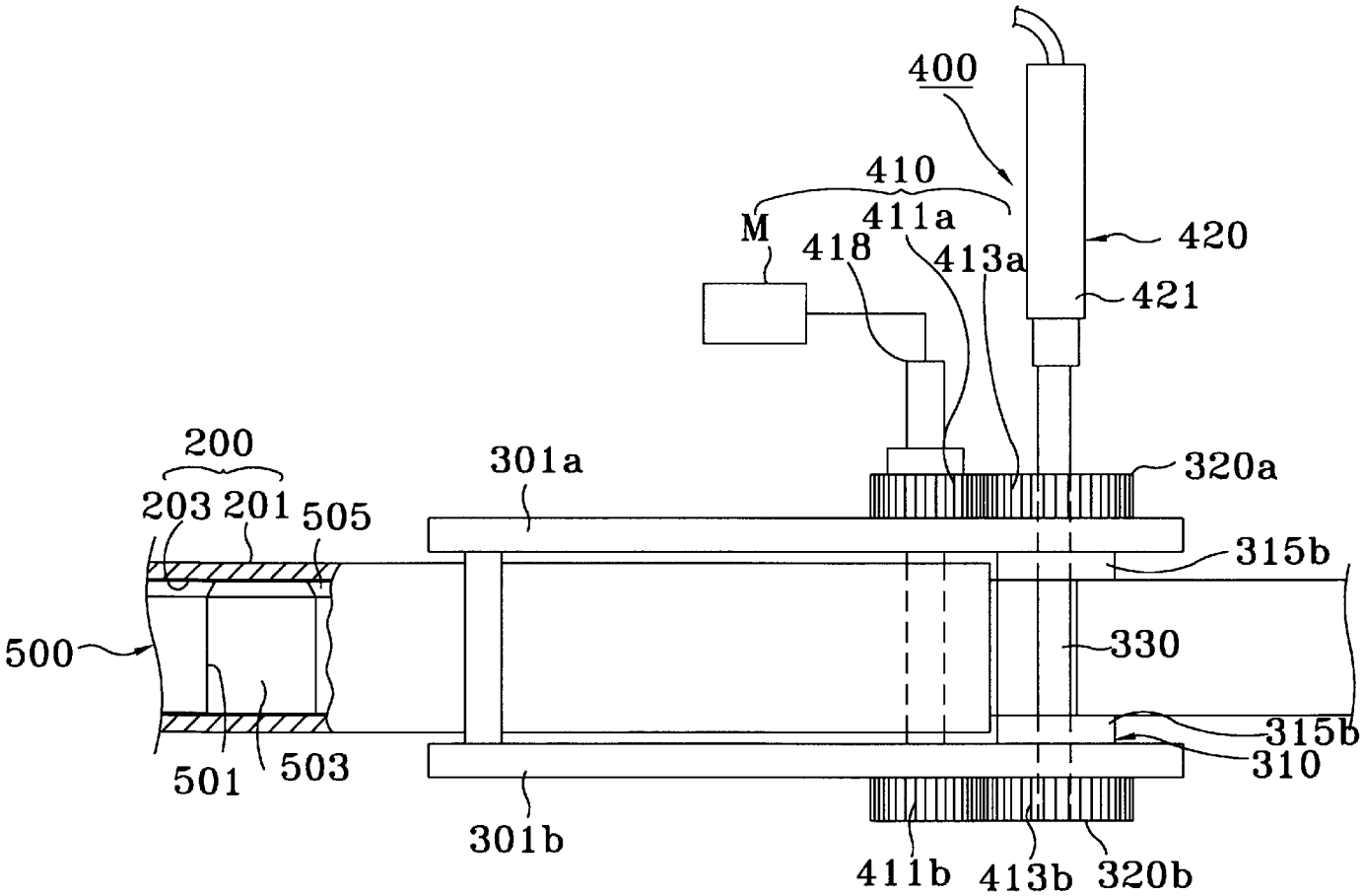
FIG. 3(PRIOR ART)
FIG. 3 is a side view of a conventional folding machine shown from a direction of arrow "B" of FIG. 1.

FIG. 1 is a perspective view showing a folding machine disclosed in Korean patent application No. 95-16975 filed by the same applicant. FIG. 2 is an exploded perspective view of the essential elements of the folding member of FIG. 1. FIG. 3 is a side view shown from a direction of arrow "B" of FIG. 1. In the conventional art, a folding machine is typically used to fold a cutting blade. However, the automatic learning apparatus for a folding machine according to the present invention is not limited to a cutting blade as the workpiece or the member to be folded. As can be seen from the drawings, the conventional art folding machine includes a guide unit 200 for guiding a member 500 to be folded, a folding unit 300 for folding the transferred member 500, and a driving unit 400 for driving the folding unit 300.

The guide unit 200 may include a guide nozzle 201 of a hollow structure configured to stably transfer the member 500 which may be passed through a cutting molding unit to the folding unit 300. The guide nozzle 201 includes a guide passage 203 of a size such that the member 500 can pass through freely.

The folding unit 300 includes a fixing body 310 connected to folding and rotary bodies 320*a* and 320*b* for the folding, which are installed on substantially rectangular shaped supporting frames 301*a* and 301*b*. The supporting frames 301*a* and 301*b* are situated spaced apart with an interval therebetween wherein the guide nozzle 201 can be situated.

The fixing body 310 for the folding function is constructed by a folding body 313 having a guide slot 311 of a size through which the member 500 can be passed, and by annular support portions 315*a* and 315*b* integrally installed on both ends of the folding body 313.

The guide slot 311 of the folding body 313 is connected with the guide passage 203 of the guide nozzle 201 such that the member 500 may freely enter inside the guide slot 311. An end side portion of the guide slot 311 is preferably formed of a slant side 312 to enhance the ability to fold member 500.

The annular support portions 315*a* and 315*b* are provided to fixedly attach the folding body 313 to the supporting frames 301*a* and 301*b*, respectively. Also, the annular support portions 315*a* and 315*b* include guiding grooves 316*a* and 316*b* of a round shape and round housing units 318*a* and 318*b* for rotatably housing the rotary bodies 320*a* and 320*b* for the folding operation. The rotary bodies 320*a* and 320*b* are configured to be rotatably housed within the round housing units 318*a* and 318*b* arranged on both sides of the fixing body 310. Also, the rotary bodies 320*a* and 320*b* have guide holes 323*a* and 323*b* pierced therein and are configured to be aligned with the guiding grooves 316*a* and 316*b*.

The guide holes 323*a* and 323*b* are provided to insertably receive a folding rod 330 to facilitate movement thereof, and are configured corresponding to a cross-sectional shape of the folding rod 330. Although an example of two guide holes 323*a* and 323*b* is shown in the drawings, only one guide hole can be set at a time during the folding operation. The folding rod 330 is dimensioned to connect the rotary bodies 320*a* and 320*b* to each other while being positioned on the outer sides of the supporting frames 301*a* and 301*b*. Accordingly, the folding rod 330 is inserted through the first guide hole 323*a* of the first rotary body 320*a*, passes through a lateral side of the fixing body 310, and is inserted into the second guide hole 323*b* inside of the second rotary body 320*b*, and is capable of being moved upwards and downwards. The folding rod 330 inserted for mutual connection of the first and second rotary bodies 320*a* and 320*b* is provided for the folding work of the member 500, revolving together with the rotary bodies 320*a* and 320*b*. Meanwhile, when a folding work is not being performed, the folding rod 330 is completely apart from the folding body 313 of the fixing body 310 and is moved towards an upper side. These operations are performed by the driving unit 400 described later. Here, although two folding rods 330 are shown in the drawings for exemplary purposes, only one can be set at a given time during the folding operation. Alternatively, one folding rod 330 may be provided and sequentially inserted on either side of folding body 313 through one of guide holes 323*a* to effect folding of member 500 in a given direction.

The driving unit 400 includes a first driving unit 410 provided to revolve the rotary bodies 320*a* and 320*b*, and a second driving unit 420 provided to move the folding rod 330 upwards and downwards from the folding body 313. The first driving unit 410 includes first toothed portions 411*a* and 411*b* which are fixed in at both ends of the rotating shaft 418 which is rotatably supported within the supporting frames 301*a* and 301*b*, second toothed portions 413*a* and 413*b* which are set on the outer circumference surfaces of the rotary bodies 320*a* and 320*b* are configured to mesh with the first toothed portions 411*a* and 411*b*, and a servo motor M which is operatively connected to the rotating shaft 418. The second driving unit 420 is a cylinder 421 connected with one end of the folding rod 330 to be moved upwards and downwards for the purpose of performing an expansion and contraction operation. Any operating source of the cylinder 421 known to one having ordinary skill in the art may be used, such as, for example, hydraulic pressure or pneumatic pressure.

The operation of the folding machine having the structure as described above will be briefly described below. First, the member 500 is guided to the guide unit 200 and transferred to the folding unit 300. Then, the second driving unit 420 is made to operate. Thus, when only one cylinder 421 of the second driving unit 420 which has been positioned at the state as shown in FIG. 3 is being descended, the folding rod 330 incorporated with the cylinder 421 is inserted into the guide holes 323*a* and 323*b* inside of the rotary bodies 320*a* and 320*b* and at the same time is positioned at any one side of the folding body 313 adjacent to the member 500. Since the guide holes 323*a* and 323*b* are in alignment, the folding rod 330 is inserted naturally when the cylinder 421 performs the falling operation.

When the movement of the folding rod 330 to the position adjacent to the member 500 is completed, the first driving unit 410 operates. The first driving unit 410 is rotated by driving the servo motor M. By driving the servo motor M, the first toothed portions 411*a* and 411*b* are simultaneously rotated by means of the rotating shaft 418. By a meshing operation between the rotating first toothed portions 411*a* and 411*b* and the second toothed portions 413*a* and 413*b*, the rotary bodies 320*a* and 320*b* for the folding are rotated about a support point of the fixing body 310. When the rotary bodies 320*a* and 320*b* are rotated, the folding rod 330 connected therewith is also integrally rotated. That is, the folding rod 330 is rotated and moved around a periphery of the fixing body 313 along the guiding grooves 316*a* and 316*b* from any one side of the fixing body 313 to perform the folding operation. At the same time, the moved folding rod 330 contacts with the member 500 which extends through the guide slot 311, thereby the member 500 is folded along the slant side 312 of the folding body 313.

Here, the folding angle of the member 500 is determined according to the magnitude of the driving voltage applied to the servo motor M.

Figure 4:
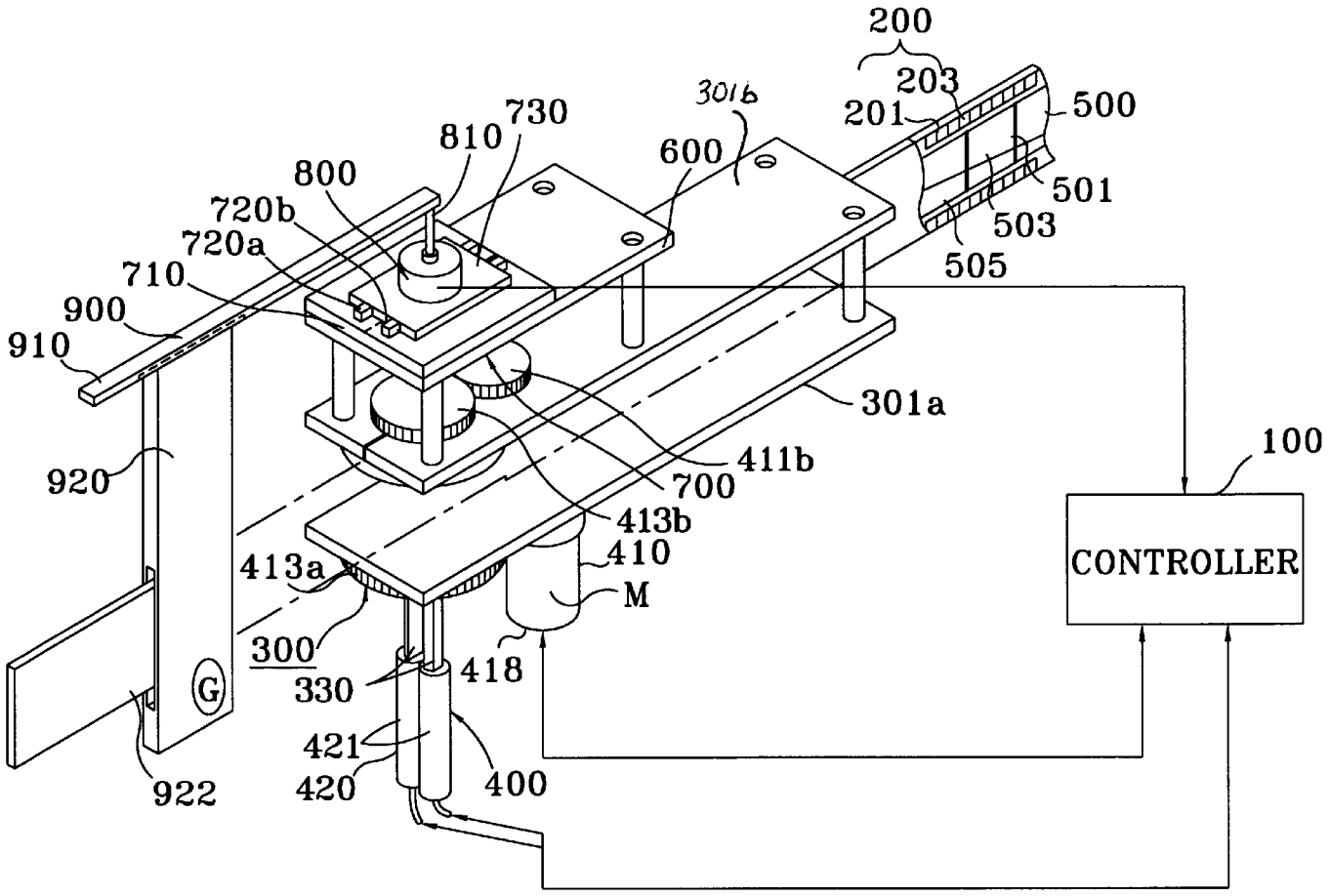
FIG. 4 is a perspective view of an automatic learning apparatus for a folding machine according to an embodiment of the present invention.

FIG. 4 is a perspective view of an automatic learning apparatus for a folding machine according to an embodiment of the present invention. As can be seen from the drawing, the folding machine of FIG. 1 is applied to the automatic learning apparatus for the folding machine of FIG. 4. Thus, the operation of the folding machine can be the same as earlier described. A base plate 600 is fixed on a support frame 301*b* of the folding machine. An encoder support member 700 is detachably attached on the base plate 600. Thus, it is preferable that the base plate 600 is made of a magnetic material and a magnet is attached on the bottom of the encoder support member 700.

The encoder support member 700 includes a rail support plate 710, a pair of rails 720*a* and 720*b* formed on the rail support plate 710, and a moving plate 730 on which an encoder 800 is fixed, wherein the moving plate 730 is engaged with the rails 720*a* and 720*b* to be slidably connected along the rails.

The longitudinal direction of the rails 720*a* and 720*b* is the same as a transferring direction of the member to be folded (i.e., the longitudinal axis defined by guide passage 203).

The encoder 800 is attached to the moving plate 730 so that a rotating shaft 810 faces upwards. The output of the encoder 800 is input to a controller 100. It is to be appreciated that the encoder 800 may be any conventional device known to one having ordinary skill in the art for converting the angular position (e.g., in degrees) of the rotation amount transferring member 900 to an electrical signal representative of such angular position. For example, a conventional sine/cosine potentiometer may be used to provide such signal to the controller 100. An analog/digital converter (not shown) may be used to convert the signal to digital form.

A rotation amount transferring member 900 is connected between the shaft of the encoder 800 and the end of the member 500 to transfer the folding rotation amount of the member 500 to the encoder 800.

The rotation amount transferring member 900 is arranged in a direction substantially perpendicular to the member 500, and includes a grip portion 920 and a connection bridge 910. The grip portion 920 grips the folding member at one end thereof and connects the other end thereof to a connection bridge 910. The connection bridge 910 is arranged in a direction substantially parallel with the member 500, in which one end thereof is associated with the grip portion 920 and the other end thereof is fixed on the rotating shaft 810 of the encoder 800.

The grip portion 920 is connected to the connection bridge 910 and will be moved according to the amount of movement of the folding member along the longitudinal direction of the connection bridge 910. Since such a structure may be implemented by combination of a spline shaft which is obvious to one having ordinary skill in the art, the detailed description thereof will be omitted. Also, a slot 922 through which the member 500 passes is formed in the grip portion 920. An elastic spring (not shown) is incorporated in the slot 922, to elastically support the member 500.

An operation of the illustrative automatic learning apparatus for the folding machine according to the present invention having the above structure will be described in more detail. The automatic learning apparatus for the folding machine according to the present invention aims at obtaining driving data to find out an accurate folding angle before folding a large number of workpieces in the same pattern. Thus, the operation of the present invention will be described until the driving data is obtained.

First, predetermined driving data is applied to a servo motor M. Then, as described above, the folding rod 330 rotates at a predetermined angle according to the applied driving data. Thus, the member 500 is folded at the same angle. In this case, the rotation amount of the member 500 (i.e., the folding angle) makes the encoder 800 rotate via the rotation amount transferring member 900.

Therefore, the encoder 800 applies a pulse corresponding to the rotation amount to the controller 100. The controller 100 recognizes the number of the pulses applied from the encoder 800 to calculate the folding angle. When the member 500 is folded at a desired angle, the driving data is recorded in a memory (not shown) incorporated in the controller 100.

Figure 5A:
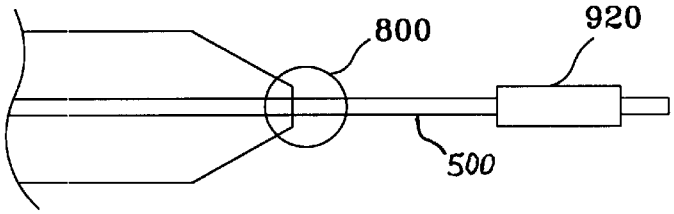
FIGS. 5A to 5C illustrate a movement of a rotation amount, a transferring member and an encoder in an automatic learning apparatus according to the present invention.
Figure 5B:
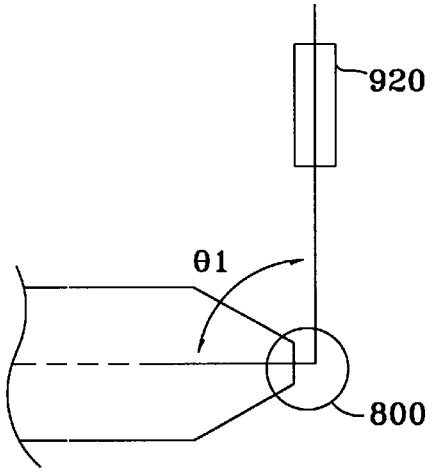
Figure 5C:
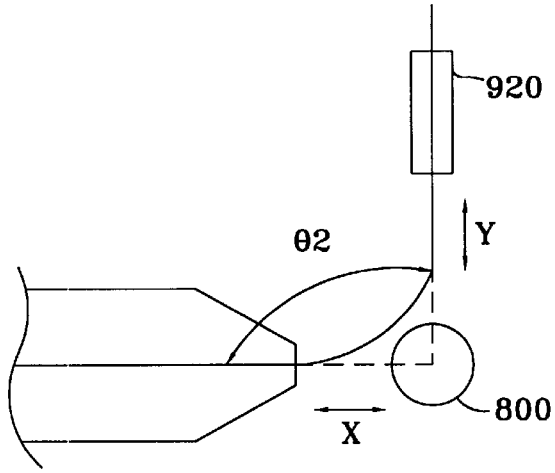

FIGS. 5A to 5C are views for explaining movement of the rotation amount transferring member and the encoder of the illustrative automatic learning folding machine according to the present invention. FIG. 5A shows the state of the member 500 prior to being folded. FIG. 5B shows the state where the member 500 is folded at an angle $\theta_1$. FIG. 5C shows the state where the member 500 is folded at an angle $\theta_2$. As can be seen from the drawings, the state before the transferred member 500 is folded is shown in FIG. 5A. When the member 500 is folded at a desired angle $\theta_1$, the state of the member 500 becomes the same as that of FIG. 5B.

As described above, when a member is folded at a predetermined angle, the encoder 800 and the grip portion 920 of the rotation amount transferring member do not need to move in a lateral direction.

However, when the member 500 is folded at a rounded angle as shown in FIG. 5C, the encoder 800 moves to an X-direction and the grip portion 920 of the rotation amount transferring member 900 moves to a Y-direction according to the movement of the member 500 in order to obtain a desired angle $\theta_2$.

Figure 6:
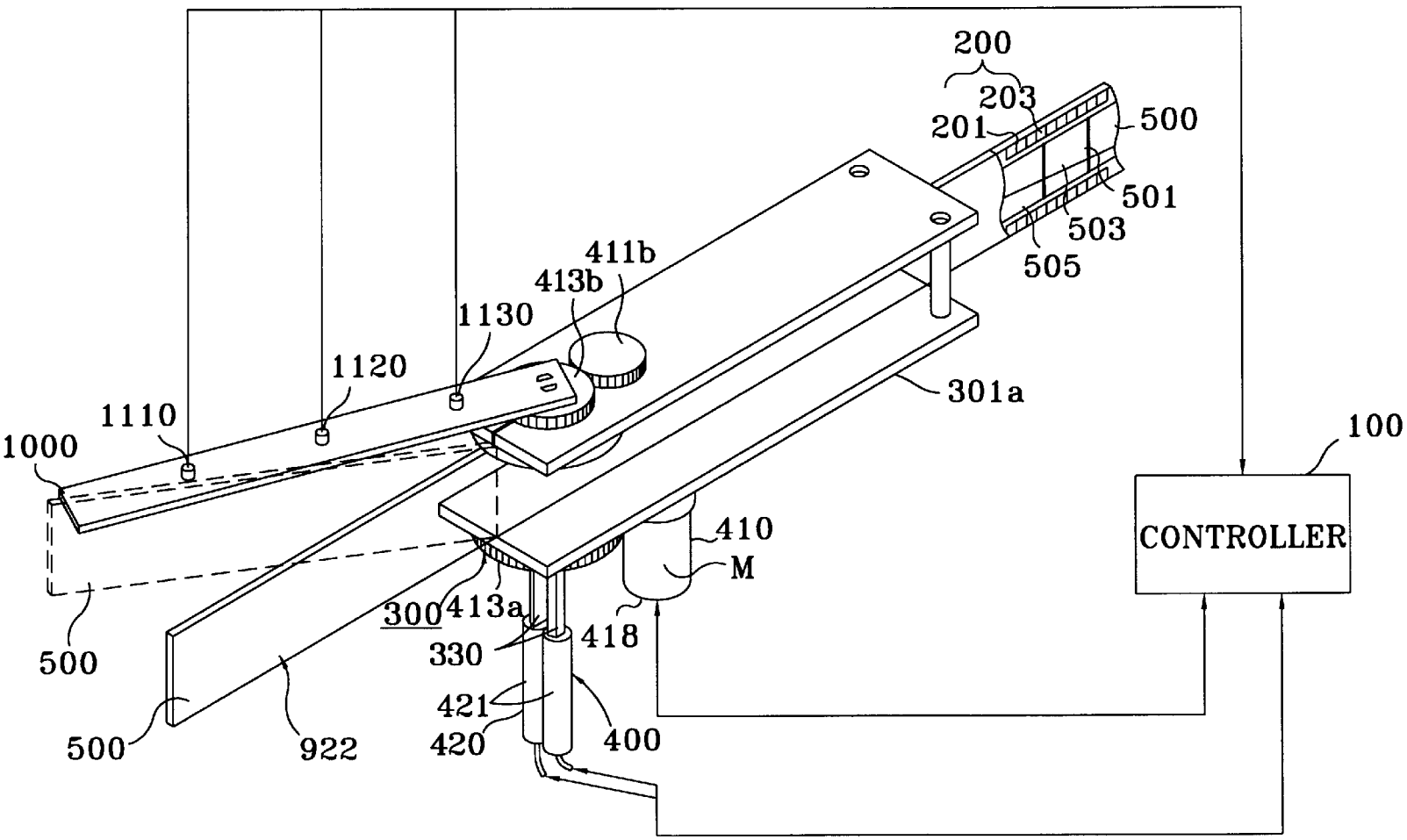
FIG. 6 is a perspective view of an automatic learning apparatus for a folding machine according to another embodiment of the present invention.

FIG. 6 is a perspective view of an automatic learning apparatus for a folding machine according to another embodiment of the present invention. In this embodiment, since the same reference numerals are used with respect to the same elements as those of the FIG. 4 embodiment, the description related thereto will be omitted. As can be seen from FIG. 6, the automatic learning apparatus for the folding machine includes a position detector 1000 which is detachably fixed to the rotary body 413*b* of the folding member.

The position detector 1000 has a predetermined length, one end of which is fixed to the upper surface of the rotary body 413*b*, and rotates together with the rotary body. Further, the position detector 1000 includes a plurality of position detection sensors 1110, 1120 and 1130 along the longitudinal direction thereof.

The operation of the automatic learning apparatus for the folding machine according to this embodiment of the present invention having the above structure will be described below in more detail. First, the controller 100 sends a signal to drive the second driving unit 420 to allow the cylinders 421 to be activated as described above. Then, the folding rods 330 are positioned in both ends around the member 500. Next, the predetermined driving data is applied to the first driving unit 410 to rotate the folding rod 330 at a predetermined angle. Thus, the member 500 may be folded at the same angle as shown as a dotted element in the drawing.

The above operation is the same as that of the first embodiment. Then, the second driving unit 420 operates to make the folding rod 330 return to the original position. Also, the controller 100 controls the first controller 410 again to then rotate the rotary body 413*b*. Therefore, the position detection sensor 1000 fixed to the rotary body 413*b* rotates to thereby detect the folded position of the member 500. The signals detected by the detection sensors 1110, 1120 and 1130 of the position detector 1000 are applied to the controller 100. The controller 100 measures a folding angle of the member to be folded using the detected signals and the data applied to the driving motor. If the measured angle corresponds to a desired folding angle, the driving data is recorded in a memory in the controller 100.

As described above, the automatic learning apparatus for the folding machine according to the present invention automatically measures and stores the driving data applied to the driving units in order to obtain a desired folding angle accurately with respect to the member for the folding of the same material before the member is actually folded. Thus, an error of the folding angle when folding a member of the same material can be avoided, and the driving data for folding can be swiftly and accurately obtained.

While only certain embodiments of the invention have been specifically described herein, it will be apparent that numerous modifications may be made thereto by one skilled in the art without departing from the spirit and scope of the invention. All such modifications are intended to be included within the scope of the invention, as defined by the appended claims.

What is claimed is:

1. An apparatus for folding metallic ribbon stock, comprising:

a guide having a passage for guiding said ribbon stock therethrough, said passage defining a longitudinal axis;

a folder including a folding member for folding ribbon stock transferred through said guide at an angle θ with respect to said longitudinal axis and a driving unit for driving the folding member;

a rotation amount transferring member having an arm position linked to the ribbon stock transferred through said guide, the arm position being aligned substantially parallel to said longitudinal axis and rotates substantially at said angle θ with respect to said longitudinal axis upon said folding of said ribbon stock; and an encoder coupled to the rotation amount transferring member for measuring said angle θ and outputting a signal representing said signal θ in a pulse form.

2. The apparatus according to claim 1, wherein said rotation amount transferring member includes an extension portion arranged in a direction substantially perpendicular to the member to be folded, said extension portion includes a grip portion, wherein said grip portion grips the member to be folded said arm portion is fixed to a rotating shaft of the encoder.

3. The apparatus according to claim 2, wherein said grip portion is movably connected to said arm portion according to the movement of the member to be folded along the longitudinal direction of said longitudinal axis.

4. The apparatus according to claim 2, wherein a slot through which the member to be folded passes is formed in said grip portion.

5. The apparatus according to claim 1, wherein said encoder is movably disposed along the longitudinal axis.

6. An apparatus for folding ribbon stock, comprising:

a folder including a first and second rotary bodies for folding said ribbon stock upon rotation of said first and second bodies;

a position detector attached to one of said first and second rotary bodies, including a plurality of position detection sensors each measuring the amount of movement of said position detector and outputting detection signals representing said amount of movement; and a controller for receiving said detection signals and having means for causing the folding of said ribbon stock by said amount of movement represented by said detection signals.

7. A metallic ribbon stock folding apparatus comprising:

a transferring unit for transfer of ribbon stock through a passage formed by a guide, said passage defining a longitudinal axis;

a rotary assembly having first and second rotary bodies spaced to receive ribbon stock therebetween;

at least one elongate member mounted for engaging both said first and second rotary bodies;

said rotary assembly configured for arcuate motion relative to said guide from a first position toward at least one second position to fold a portion of said ribbon stock by said elongate member;

an encoder for measuring an angle θ formed by said ribbon stock with respect to said longitudinal axis folded by said folding apparatus; and a memory for storing signals representing said angle θ received from said encoder.

8. The apparatus according to claim 7, further including a controller for reading said memory, said controller including means for folding another ribbon stock by said angle.

* * * * *